US009995103B2

(12) United States Patent
Wakefield et al.

(10) Patent No.: US 9,995,103 B2
(45) Date of Patent: Jun. 12, 2018

(54) EXTENDED REACH ANTI-EXTRUSION RING ASSEMBLY WITH ANCHORING FEATURE

(71) Applicant: BAKER HUGHES INCORPORATED, Houston, TX (US)

(72) Inventors: John K. Wakefield, Cypress, TX (US); Edward T. Wood, Kingwood, TX (US); Aubrey C. Mills, Magnolia, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 150 days.

(21) Appl. No.: 14/918,102

(22) Filed: Oct. 20, 2015

(65) Prior Publication Data

US 2017/0107783 A1 Apr. 20, 2017

(51) Int. Cl.
*E21B 33/12* (2006.01)
*E21B 33/128* (2006.01)

(52) U.S. Cl.
CPC ..... *E21B 33/1216* (2013.01); *E21B 33/128* (2013.01)

(58) Field of Classification Search
CPC ..... E21B 33/1293; E21B 33/1208; E21B 33/1216; F16J 15/166
See application file for complete search history.

(56) References Cited

U.S. PATENT DOCUMENTS

| | | | | |
|---|---|---|---|---|
| 3,559,733 | A * | 2/1971 | Kilgore | E21B 33/1293 166/134 |
| 4,204,690 | A | 5/1980 | Arendt et al. | |
| 5,358,054 | A * | 10/1994 | Bert | E21B 33/10 166/181 |
| 6,598,672 | B2 | 7/2003 | Bell et al. | |
| 7,708,080 | B2 | 5/2010 | Conaway et al. | |
| 8,479,809 | B2 | 7/2013 | Farquhar | |
| 8,701,787 | B2 | 4/2014 | Shkurti et al. | |
| 9,140,094 | B2 | 9/2015 | Yee et al. | |
| 2002/0070503 | A1* | 6/2002 | Zimmerman | E21B 33/1208 277/337 |
| 2004/0036225 | A1 | 2/2004 | Ritter et al. | |
| 2012/0018143 | A1 | 1/2012 | Lembcke | |

(Continued)

FOREIGN PATENT DOCUMENTS

| | | |
|---|---|---|
| WO | 2011028404 | 3/2011 |
| WO | 2013128222 A1 | 9/2013 |

*Primary Examiner* — D. Andrews
(74) *Attorney, Agent, or Firm* — Steve Rosenblatt

(57) ABSTRACT

A sealing element is flanked by wedge-shaped extrusion ring assemblies. The rings climb a ramp on an adjacent pedestal ring on the way out to the borehole wall. Depending on the dimension of the gap to be spanned the extrusion rings slide part way up the pedestal ring ramp or to the top of the pedestal ring. An anchor ring is initially forced up an opposite ramp of the pedestal ring. If the sealing gap is short the anchor ring touches the borehole wall to act as an anchor for the plug while remaining spaced apart from the extrusion ring assembly. For larger gaps the anchor ring moves out far enough to the borehole wall and in contact with the extrusion ring located on top of the pedestal so that reaction forces are directed to keep the anchor ring wedged in position for support of the extrusion ring assembly.

20 Claims, 1 Drawing Sheet

(56) References Cited

U.S. PATENT DOCUMENTS

| | | | |
|---|---|---|---|
| 2013/0147120 | A1 | 6/2013 | O'Malley |
| 2013/0192853 | A1 | 8/2013 | Themig |
| 2013/0306330 | A1 | 11/2013 | Bishop et al. |
| 2015/0285025 | A1 | 10/2015 | Hughes et al. |

* cited by examiner

EXTENDED REACH ANTI-EXTRUSION RING ASSEMBLY WITH ANCHORING FEATURE

FIELD OF THE INVENTION

The field of the invention is sealing systems for subterranean tools against tubular or open hole and more particularly anti-extrusion barriers for a seal element that have extended reach with a backup anchoring feature.

BACKGROUND OF THE INVENTION

In the unconventional drilling and completion industry, oil and gas deposits are often produced from tight reservoir formations through the use of fracturing and frack packing methods. To frack a well involves the high pressure and high velocity introduction of water and particulate media, typically a sand or proppant, into the near wellbore to create flow paths or conduits for the trapped deposits to flow to surface, the sand or proppant holding the earthen conduits open. Often, wells have multiples of these production zones. Within each production zone it is often desirable to have multiple frack zones. For these operations, it is necessary to provide a seal known as a frack packer, between the outer surface of a tubular string and the surrounding casing or borehole wall, below the zone being fractured, to prevent the pumped fluid and proppant from travelling further down the borehole into other production zones. Therefore, there is a need for multiple packers to provide isolation both above and below the multiple frack zones.

A packer typically consists of a cylindrical elastomeric element that is compressed axially, or set, from one end or both by gages within a backup system that cause the elastomer to expand radially and form a seal in the annular space. Gages are compressed axially with various setting mechanisms, including mechanical tools from surface, hydraulic pistons, atmospheric chambers, etc. Setting typically requires a fixed end for the gages to push against. These fixed ends are often permanent features of a mandrel but can include a dynamic backup system. When compressed, the elastomeric seal has a tendency to extrude past the gages. Therefore, anti-extrusion backups have become common in the art. However, typical elastomeric seals maintain the tendency to extrude through even the smallest gaps in an anti-extrusion backup system.

In cased-hole applications, anchoring of compression set packers is a common feature in the completion architecture. Anchoring is provided by wedge-shaped slips with teeth that ride up ramps or cones and bite into the casing before a packer is set. These systems are not part of the backup system nor are they designed to provide anti-extrusion. Often they are used in the setting of the packer to center the assembly which lowers the amount of axial force needed to fully set the elastomer seal. Once set, anchoring systems are also useful for the life of the packer to provide a uniform extrusion gap, maintain location and help support the weight of a bottom-hole assembly in the case of coiled tubing frack jobs. Anchors also prevent tube movement in jointed strings resulting from the cooling of the string by the frack fluid. Movement of the packers can cause them to leak and lose seal.

In open-hole frack pack applications it is rarer for the packer to have anchoring mechanisms, as the anchor teeth create point load locations that can overstress the formation, causing localized flow paths around the packer through the near well-bore. However, without anchors, movement from the base pipe tubing can further energize the elastomeric seal. Energizing the seal from tube movement tends to overstress the near wellbore as well, leading to additional overstressing of the wellbore, allowing communication around the packer, loss of production, and potential loss of well control to surface. However, the art of anchoring has been reintroduced in new reservoirs in deep-water open-hole fracking operations. The current state of the art in open-hole frack pack operations requires a choice between losing sealing due to anchor contact induced fractures, packer movement, or over-energizing of the elastomeric element.

Extrusion barriers involving tapers to urge their movement to block an extrusion path for a sealing element have been in use for a long time as evidenced by U.S. Pat. No. 4,204,690. Some designs have employed tapered surfaces to urge the anti-extrusion ring into position by wedging them outwardly as in U.S. Pat. No. 6,598,672 or in some cases inwardly as in U.S. Pat. No. 8,701,787. Other designs simply wrap thin metal rings at the extremities of the sealing element that are designed to contact the surrounding tubular to create the anti-extrusion barrier. Some examples of these designs are U.S. Pat. Nos. 8,479,809; 7,708,080; US 2012/0018143 and US 2013/0147120. Of more general interest in the area of extrusion barriers are U.S. Pat. No. 9,140,094 and WO 2013/128222.

In some applications the gap across which the seal is expected to function is quite large placing such applications beyond the limits of the design in U.S. Pat. No. 6,598,672. There is a need for an extended reach design that can withstand the pressure differentials. The present invention addresses this need with a wedge shaped extrusion ring assembly that, depending on the gap to be spanned is pushed on opposing ramps and then onto a pedestal ring for extended reach. To fixate the extrusion ring in the extended position a backup ring also moves into contact with the extrusion ring in its extended position on the pedestal ring. In the extended reach configuration of the extrusion ring, the backup ring moves part way toward the surrounding tubular or borehole. In shorter reach applications the extrusion ring and the backup ring can move out to the surrounding tubular or borehole wall on opposed sides of the pedestal ring. The backup ring is wedged against the surrounding borehole wall to allow it to act as an anchor for the plug that has the sealing system. In the extended reach configuration the reaction forces from the extrusion ring are directed into the abutting backup ring and into the setting system so that the backup ring is prevented from being squeezed out of its wedged position against the pedestal ring. These and other aspects of the present invention will be more readily apparent to those skilled in the art from a review of the description of the preferred embodiment and the associated drawings while understanding that the full scope of the invention is to be found in the appended claims.

SUMMARY OF THE INVENTION

A sealing element is flanked by wedge-shaped extrusion ring assemblies. The rings climb a ramp on an adjacent pedestal ring on the way out to the borehole wall. Depending on the dimension of the gap to be spanned the extrusion rings slide part way up the pedestal ring ramp or to the top of the pedestal ring. An anchor ring is initially forced up an opposite ramp of the pedestal ring. If the sealing gap is short the anchor ring touches the borehole wall to act as an anchor for the plug while remaining spaced apart from the extrusion ring assembly. For larger gaps the anchor ring moves out far enough to the borehole wall and in contact with the extrusion ring located on top of the pedestal so that reaction forces are directed to keep the anchor ring wedged in position for support of the extrusion ring assembly.

DETAILED DESCRIPTION OF THE PREFERRED EMBODIMENT

Figure 1:
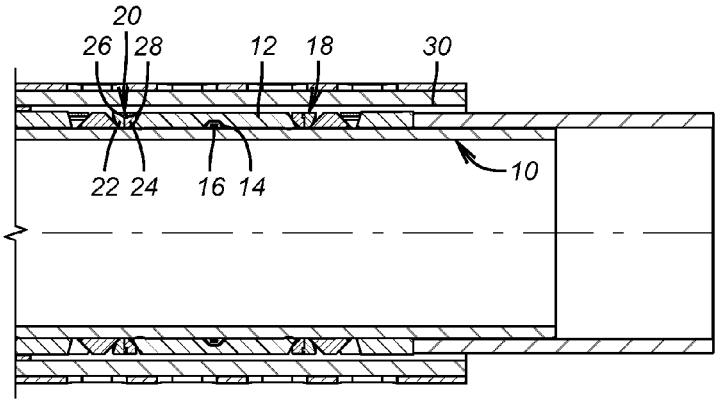
FIG. 1 is a section view of the sealing system in the run in position of a subterranean plug.
Figure 4:
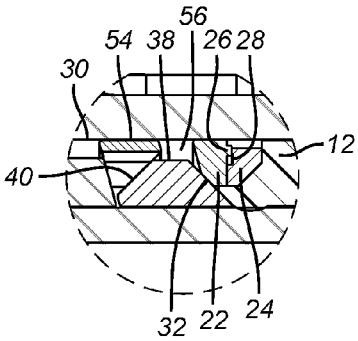
FIG. 4 is an enlarged view of FIG. 2.
Figure 3:
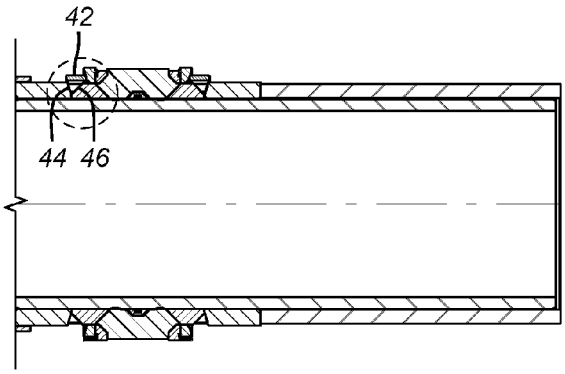
FIG. 3 is the view of FIG. 1 when set in a larger sealing gap with the extrusion ring on top of the pedestal ring and backed up by an anchor ring.
Figure 5:
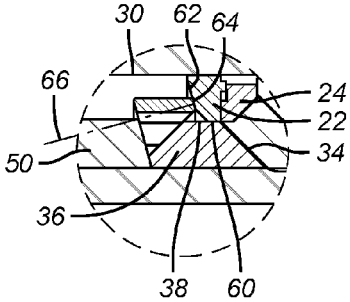
FIG. 5 is an enlarged view of FIG. 3.

FIG. 1 shows a plug mandrel 10 having a sealing element 12 surrounding it. The element 12 can have an optional internal seal ring 14 that has an optional o-ring seal 16 against the mandrel 10. Extrusion ring assemblies 18 and 20 flank seal 12 on opposed ends. Each extrusion ring assembly is preferably made from two or more split rings such as 22 and 24 that are held together while allowing some relative movement by an arrangement of a lug 26 in a groove 28. The splits in these rings are not shown but are preferably circumferentially offset by about 120-180 degrees. Groove 28 can be closed ended as shown in FIG. 4 or open ended as shown in FIG. 5. The same construction described above is preferably used at opposing ends of seal 12. Rings 22 and 24 can move radially relative to each other toward a final position where either both engage the surrounding borehole wall as shown in FIG. 4 or only one engages the borehole wall 30. Collectively each pair of rings such as 22 and 24 present a wedge shape in section from the opposed tapers, one on each of the abutting rings.

Ring 22 has a surface 32 that rides on parallel surface 34 of pedestal ring 36. Pedestal ring 36 also has an outer surface 38 and another ramp surface 46 opposite ramp 34. Anchor ring 42 has opposed tapered surfaces 44 and 46 giving it a generally quadrilateral shape while most of the section shape resembles a triangle. Pedestal ring 36 is in section a generally trapezoidal shape and may have an angle truncated where it abuts setting ring 50. Taper 44 rides on parallel taper 48 on setting ring 50. The mating tapers 48 and 44 are at a larger angle with respect to an axis of the mandrel 10 to allow the anchor ring 42 to start moving first when setting rings 50 and 52 get pushed closer together in the setting process that relies on axial compression of the illustrated outer assembly. Taper 46 rides on taper 40 of the pedestal ring 36. Ring 24 abuts the sealing element 12. The parts against the sealing element 12 are in mirror image so the movement described on one side of the sealing element 12 occurs on the opposite side.

Figure 2:
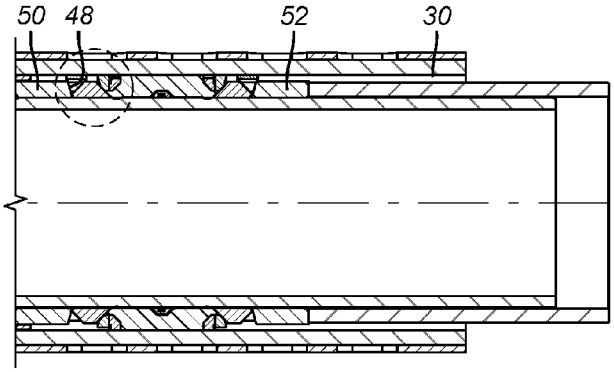
FIG. 2 is the view of FIG. 1 when set in a smaller sealing gap with the extrusion ring assembly moved part way up the pedestal ring.

If the sealing gap is narrow as illustrated in FIG. 2 the anchor ring 42 will come out to the borehole wall 30 due to sliding contact of surfaces 44 and 48 until surface 54 of ring 42 engages wall 30 as shown in FIG. 4. Extrusion ring 20, for example, will slide up along abutting surfaces 32 and 34 until contact is made with wall 30. In the narrow gap example, movement of extrusion ring assembly 20, for example, will stop on ramp surface 34 short of outer surface 38 as shown in detail in FIG. 4. Anchor ring 42 will be wedged against wall 30 on an opposite side of pedestal ring 36 from ring 22 which will still be bearing on tapered surface 34. The extrusion ring assembly 20 made up of relatively movable split rings with offset splits 22 and 24 will be wedged between the pedestal ring 36 and the sealing element 12 to close off the gap 56. The wedged position of anchor ring 42 stabilizes the size of the gap 56 to avoid the overstressing the borehole problem described above due to shifting of the mandrel 10 particularly in open hole applications where slips are not used for anchoring. In this small gap situation the rings 22 and 24 wind up moving radially outwardly the same distance to get to the borehole wall 30. As stated before, what happens on one side of the sealing element 12 occurs on the opposite side but the description of the mirror image action is not repeated to make the description compact.

In the event the gap to the borehole wall 30 is larger, the same pattern of movement takes place except that the extrusion ring assembly 20 moves out radially further and the anchor ring does not reach the borehole wall 30. Instead, surface 60 of ring 22 is pushed beyond surface 34 of the pedestal ring 36 and onto surface 38 as shown in FIG. 5. Surface 62 of ring 22 is propped up by parallel surface 64 on anchor ring 42 such that the line of force transfer extends into end ring 50 to hold the extrusion ring assembly 20 in position against wall 30 from the pressure in the compressed sealing element 12. The angles of surface pairs 40 and 46 with 44 and 48 in conjunction with the resulting line of force transfer 66 wedges anchor ring 42 in the FIG. 5 position fully supporting the extrusion ring assembly 20 against the borehole wall 30. It is possible that ring 24 may be embedded in the sealing element 12 or fully on the outer surface 38 with ring 22 although only the former end position is shown in FIG. 5 where ring 24 has moved out radially less than ring 22 and the groove 28 may be open ended.

Those skilled in the art will appreciate distinct features of the invention from the above description. In smaller gap situations an anchor ring contacts the borehole wall to fixate a mandrel initially as an extrusion ring assembly then moves to close the gap sliding on opposite side of a pedestal ring from the anchor ring. The taper angles on the anchor ring are configured to keep the anchor ring extended in reaction to pressure in the sealing element on the extrusion ring assembly that is transferred through the pedestal ring to the anchor ring. The anchor ring and extrusion ring assembly remain spaced apart on opposed sides of the pedestal ring.

When spanning a larger gap, the anchor ring leads the extrusion ring assembly as the extrusion ring assembly or a part thereof climbs up on an outer surface of the pedestal ring. The anchor ring slides on an opposite side of the pedestal ring until contacting the extrusion ring that is against the borehole wall. The position of the angled surfaces on opposed sides of the anchor ring wedge it in position so that reaction forces from the sealing element and into the extrusion ring assembly get transmitted into the anchor ring and from there directly into one of the setting rings for the seal assembly.

Various design variations are contemplated. The extrusion ring assembly rings may or may not be interlocked. For purposes of anchoring in a tubular or open-hole formation wall, the anchor ring and the extrusion ring assembly may have features useful for gripping such as carbide grit, wickers, or teeth. These gripping features are illustrative only and any technique known in the art may be utilized to form an anchor area.

The anchor ring may be used in unidirectional anchoring to prevent energizing of the sealing element, preventing excess formation stress due to tube movement. The extrusion ring assembly and the pedestal ring may be disposed in such a way that tube movement from one direction only loads up one anchor ring.

For purposes of limiting the stress to near the borehole wall the sealing element or extrusion ring assembly or the anchoring ring may have a useful load range at which they shear away to allow packer movement. The anchoring feature is composed of applied carbide grit on the outside diameter of the extrusion ring assembly that has a shear rating of 5000 PSI. After the grit has experienced 5000 PSI or higher, locally, it may be separated from the extrusion ring assembly, allowing the packer to move axially and prevent stress build-up in the packer and formation, while preventing extrusion.

To prevent premature setting during trip-in to the bottom of the wellbore, the anchoring features on the extrusion ring assembly may be coated with an epoxy, polymer, or resin that is soft enough for the gripping features to bite through once a certain setting force is applied from a setting mechanism (not shown). Any coating may be used; epoxy, polymer, or resin for example.

In one embodiment, extrusion of the sealing element is prevented by modification of the ends of the sealing element. Modifications can include localized vulcanization, webbing such as that made by Kevlar or other suitably strong material, embedded particles, embedded rings or springs, or any other technique known in the art useful for mitigating elastomer extrusion.

In another embodiment, the sealing element is an elastomer which maintains rubbery properties until set, at which point it may undergo a predetermined phase change, accelerated mechanical aging or other means of hardening to prevent extrusion, whether due to temperature, time, introduction of a chemical, and any other mechanism or combination thereof.

The anchor ring can be a single piece or a split ring that is resilient to the point of being capable of being wedged out in a radial direction toward the borehole wall. In this manner the loading from the ring 42 on the borehole wall 30 will be uniformly distributed as opposed to slip segments that break apart when extended and apply concentrated loads that increase the local stress.

The above description is illustrative of the preferred embodiment and many modifications may be made by those skilled in the art without departing from the invention whose scope is to be determined from the literal and equivalent scope of the claims below:

We claim:

1. A compression set sealing system for a subterranean tool, comprising:

a mandrel;

an annularly shaped sealing element mounted over said mandrel and selectively radially extended to span a predetermined sealing gap to a borehole wall as a result of relative axial movement of spaced setting surfaces;

an extrusion ring assembly on at least one end of said sealing element in contact therewith;

a pedestal ring separating, for running in, an anchor ring from said extrusion ring assembly on at least one end of said sealing element and shaped to move said extrusion ring assembly and anchor ring radially toward said borehole wall as a result of said relative axial movement of said spaced setting surfaces, said pedestal ring having a radially outermost surface with at least a part of said extrusion ring assembly moving onto said radially outermost surface when sealing said gap to the borehole wall, said anchor ring, with said extrusion ring assembly against the borehole wall, moving short of the borehole wall when said sealing gap to the borehole wall exceeds a predetermined distance.

2. The system of claim 1, wherein:

said anchor ring contacts said extrusion ring assembly in said radially extended position of said sealing element.

3. The system of claim 2, wherein:

said anchor ring is wedged toward said mandrel by force transmitted from contact by said extrusion ring assembly.

4. The system of claim 1, wherein:

said extrusion ring assembly comprises relatively movable rings at least one of which moves onto said radially outermost surface of said pedestal ring.

5. The system of claim 1, wherein:

said anchor ring is moved toward the borehole wall ahead of said extrusion ring assembly.

6. The system of claim 1, wherein:

said anchor ring is a complete or split ring.

7. A compression set sealing system for a subterranean tool, comprising:

a mandrel;

an annularly shaped sealing element mounted over said mandrel and selectively radially extended to span a predetermined sealing gap to a borehole wall as a result of relative axial movement of spaced setting surfaces;

an extrusion ring assembly on at least one end of said sealing element in contact therewith;

a pedestal ring separating, for running in, an anchor ring from said extrusion ring assembly on at least one end of said sealing element and shaped to move said extrusion ring assembly and anchor ring radially toward said borehole wall as a result of said relative axial movement of said spaced setting surfaces, said pedestal ring having an outer surface with at least a part of said extrusion ring assembly moving onto said outer surface when sealing said gap to the borehole wall;

said anchor ring contacts said extrusion ring assembly in said radially extended position of said sealing element;

said anchor ring does not extend to the borehole wall when contacting said extrusion ring assembly in said radially extended position of said sealing element.

8. The system of claim 7, wherein:

said extrusion ring assembly and said anchor ring move into contact on substantially parallel surfaces.

9. The system of claim 8, wherein:

force transmitted through said substantially parallel surfaces is directed into one of said spaced setting surfaces.

10. The system of claim 9, wherein:

said anchor ring is wedged toward said mandrel by force transmitted from contact by said extrusion ring assembly.

11. The system of claim 10, wherein:

said anchor ring is moved toward the borehole wall ahead of said extrusion ring assembly.

12. The system of claim 11, wherein:

said extrusion ring assembly comprises relatively movable rings at least one of which moves onto said outer surface of said pedestal ring.

13. The system of claim 12, wherein:

at least one of said rings engages the borehole wall when in contact with said anchor ring.

14. The system of claim 13, wherein:

said rings comprise a first and a second ring;

said first ring engages said anchor ring and the borehole wall and said second ring engages said sealing element and not the borehole wall when said sealing element is radially extended.

15. A compression set sealing system for a subterranean tool, comprising:

a mandrel;

an annularly shaped sealing element mounted over said mandrel and selectively radially extended to span a predetermined sealing gap to a borehole wall as a result of relative axial movement of spaced setting surfaces;

an extrusion ring assembly on at least one end of said sealing element in contact therewith;

a pedestal ring separating, for running in, an anchor ring from said extrusion ring assembly on at least one end of said sealing element and shaped to move said extrusion ring assembly and anchor ring radially toward said borehole wall as a result of said relative axial movement of said spaced setting surfaces, said pedestal ring having an outer surface with at least a part of said extrusion ring assembly moving onto said outer surface when sealing said gap to the borehole wall;

aid extrusion ring assembly and said anchor ring move into contact on substantially parallel surfaces.

16. The system of claim 15, wherein:

force transmitted through said substantially parallel surfaces is directed into one of said spaced setting surfaces.

17. The system of claim 16, wherein:

said rings are held together while moving relatively radially with respect to said mandrel with a lug in a groove.

18. The system of claim 17, wherein:

at least one of said rings engages the borehole wall when in contact with said anchor ring.

19. The system of claim 18, wherein:

said rings comprise a first and a second ring;

said first ring engages said anchor ring and the borehole wall and said second ring engages said sealing element and not the borehole wall when said sealing element is radially extended.

20. A compression set sealing system for a subterranean tool, comprising:

a mandrel;

an annularly shaped sealing element mounted over said mandrel and selectively radially extended to span a predetermined sealing gap to a borehole wall as a result of relative axial movement of spaced setting surfaces;

an extrusion ring assembly on at least one end of said sealing element in contact therewith;

a pedestal ring separating, for running in, an anchor ring from said extrusion ring assembly on at least one end of said sealing element and shaped to move said extrusion ring assembly and anchor ring radially toward said borehole wall as a result of said relative axial movement of said spaced setting surfaces, said anchor ring comprises an expandable complete or split ring wedged toward the borehole wall without engaging the borehole wall when said sealing gap to the borehole wall exceeds a predetermined distance and said extrusion ring assembly is against the borehole wall by opposed sloping surfaces on one of said setting surfaces and said pedestal ring and provides uniformly distributed loading on the borehole wall when the sealing, gap does not exceed the predetermined distance.

* * * * *